US010695930B2

(12) United States Patent
Dijon et al.

(10) Patent No.: US 10,695,930 B2
(45) Date of Patent: Jun. 30, 2020

(54) ROTARY CUTTING APPARATUS WITH AN EMBEDDED MONITORING UNIT

(71) Applicant: HYPERION MATERIALS & TECHNOLOGIES (SWEDEN) AB, Stockholm (SE)

(72) Inventors: Pierre-Luc Paul Andre Dijon, Salaise sur Sanne (FR); Arnaud Joel Pras, Jarcieu (FR); Jacques Secondi, Monsteroux Milieu (FR)

(73) Assignee: HYPERION MATERIALS & TECHNOLOGIES (SWEDEN) AB (SE)

( * ) Notice: Subject to any disclaimer, the term of this patent is extended or adjusted under 35 U.S.C. 154(b) by 119 days.

(21) Appl. No.: 15/762,634

(22) PCT Filed: Oct. 3, 2016

(86) PCT No.: PCT/EP2016/073562
§ 371 (c)(1),
(2) Date: Mar. 23, 2018

(87) PCT Pub. No.: WO2017/060196
PCT Pub. Date: Apr. 13, 2017

(65) Prior Publication Data

US 2018/0354149 A1 Dec. 13, 2018

(30) Foreign Application Priority Data

Oct. 6, 2015 (EP) ..... 15306573

(51) Int. Cl.

| | |
|---|---|
| ***B26D 5/00*** | (2006.01) |
| ***B26D 7/26*** | (2006.01) |
| ***B26F 1/38*** | (2006.01) |

(52) U.S. Cl.
CPC ..... *B26D 5/00* (2013.01); *B26D 7/26* (2013.01); *B26D 7/265* (2013.01); *B26F 1/384* (2013.01); *B26F 1/38* (2013.01)

(58) Field of Classification Search
CPC .... B26D 5/00; B26D 7/26; B26D 7/27; B26F 1/384
See application file for complete search history.

(56) References Cited

U.S. PATENT DOCUMENTS 4,062,593 A * 12/1977 Gapper ..... E21C 31/10 299/1.6
4,325,580 A * 4/1982 Swisher, Jr. ..... B28D 1/186 299/39.8

(Continued)

FOREIGN PATENT DOCUMENTS

CN 203432616 U 2/2014
EP 0841132 A1 5/1998

(Continued)

*Primary Examiner* — Sean M Michalski

(57) ABSTRACT

The disclosure is related to a rotary cutting apparatus (10) comprising a frame (12); a first rotary device (14 or 16) comprising a first shaft concentrically arranged about a first rotational axis (A or B) and a first drum (37 or 38); a second rotary device (14 or 16) comprising a second shaft concentrically arranged about a second rotational axis (A or B) and a second drum (37 or 38); said first and second rotational axes being substantially horizontal and substantially in the same plane, wherein, a monitoring unit (28) is at least partially embedded in at least one of the drums of the first and second rotary devices, the monitoring unit being configured for measuring at least one working parameter and for transmitting data representative of the at least one working parameter between the monitoring unit and an interface transmission unit positioned outside either the first or second rotary device or both.

20 Claims, 3 Drawing Sheets

(56) References Cited

U.S. PATENT DOCUMENTS 4,580,144 A * 4/1986 Calvi ..... G07B 17/00508 101/109
4,715,657 A * 12/1987 Sato ..... E21C 35/24 299/1.6
5,022,295 A * 6/1991 Stemmler ..... B26D 7/10 100/305
5,048,387 A * 9/1991 Niitsuma ..... B41F 13/62 83/344
5,312,163 A * 5/1994 Hanamoto ..... E21B 7/068 299/1.05
5,632,200 A * 5/1997 Fukai ..... B41L 13/06 101/114
6,158,337 A * 12/2000 Hara ..... B41L 13/06 101/116
6,188,222 B1 * 2/2001 Seydoux ..... E21B 47/12 324/339
6,844,814 B2 * 1/2005 Chin ..... G08B 25/10 340/539.11
6,848,503 B2 * 2/2005 Schultz ..... E21B 41/0085 166/66.5
6,911,828 B1 * 6/2005 Brossia ..... G01N 17/02 324/649
7,007,579 B2 * 3/2006 Marlow ..... B23D 25/12 29/2
7,833,367 B2 * 11/2010 Yamamoto ..... B26D 7/26 156/350
8,464,623 B2 * 6/2013 Peshkar ..... B26D 7/10 83/879
9,222,350 B2 * 12/2015 Vaughn ..... E21B 10/36
10,329,855 B2 * 6/2019 Brady ..... E21B 17/00
2003/0061921 A1 * 4/2003 Chen ..... B23D 59/001 83/13
2006/0257193 A1 * 11/2006 Aichele ..... B26D 7/22 400/621
2007/0173969 A1 * 7/2007 Nicastro ..... B26D 1/626 700/177
2010/0294099 A1 * 11/2010 Van Laar ..... B26D 1/16 83/72
2012/0121802 A1 * 5/2012 Zimmer ..... C08L 23/02 427/207.1
2012/0255411 A1 * 10/2012 Dijon ..... B26D 7/265 83/344
2012/0255412 A1 * 10/2012 Dijon ..... B26D 1/405 83/344
2014/0033886 A1 * 2/2014 Hoover ..... B26D 5/02 83/39
2014/0041493 A1 * 2/2014 Dulaney ..... B26F 1/384 83/13
2018/0354149 A1 * 12/2018 Dijon ..... B26D 7/26

FOREIGN PATENT DOCUMENTS

EP 1798011 A1 6/2007
EP 2508311 A1 10/2012
WO 00/73029 A1 12/2000

* cited by examiner

ROTARY CUTTING APPARATUS WITH AN EMBEDDED MONITORING UNIT

TECHNICAL FIELD

The present disclosure relates to a rotary cutting apparatus comprising a monitoring unit (28) being at least partially embedded in at least one of the first and the second drums (37 or 38) of the first and the second rotary devices (14 or 16), the monitoring unit (28) being configured for measuring at least one working parameter and for transmitting data representative of the at least one working parameter between the monitoring unit (28) and an interface transmission unit positioned outside either the first or second rotary device or both.

Furthermore, the present disclosure also relates to a method for transmitting data and energy.

BACKGROUND

Rotary cutting apparatus is for example known from EP-A-2 508 311.

However, when using rotary cutting apparatus, functional disorders may occur with the apparatus and/or also the apparatus may be exposed to wear. A usual reaction of the skilled person to solve this is to increase the cutting pressure of the rotary cutting apparatus in order to obtain a good cut once again until the maximum pressure is reached. When this happens, there will be no other solution than to stop the rotary cutting apparatus in order to change the broken and/or worn parts. Thus, this will mean severe consequences for both productivity and efficiency of the rotary cutting apparatus. Furthermore, the increase of cutting pressure will also shorten the lifetime of the equipment.

SUMMARY OF THE DISCLOSURE

An aspect of the present disclosure is to provide an improved rotary cutting apparatus which will solve and/or reduce the problems mentioned above. The present disclosure therefore relates to a rotary cutting apparatus comprising a monitoring unit at least partially embedded in at least one of the first or the second drums of the first and the second rotary devices, the monitoring unit being configured for measuring at least one working parameter and for transmitting data representative of the at least one working parameter between the monitoring unit and an interface transmission unit positioned outside either the first or second rotary device or both. By measuring and following important working parameters, it will be possible to know when a maintenance operation is needed and also what maintenance is needed to be performed, such as for example preventive maintenance. A preventive maintenance operation is for example cleaning, checking and adjusting the equipment.

The monitoring unit, which is at least partially embedded in at least one of the first and the second drums will obtain, while machining is performed, accurate measurements relating to the cutting operation, such as the number of produced work-piece and/or a temperature of a cutting edge. Indeed, the position of the monitoring unit enables the disposition of sensing means very close to the external surface of the rotary device in which the monitoring unit is at least partially embedded thereby improving the accuracy of the measurements carried out in a remote position from the rotary devices and/or the cutting area.

According to one embodiment the monitoring unit may be at least partially embedded in both of the first and second drums of the first and the second rotary devices.

According to the present disclosure, the "cutting area" refers to a space closely surrounding the first and second rotary devices, particularly around a cutting edge provided onto the first or the second rotary device, when the rotary cutting apparatus is running.

The at least one working parameter refers to a physical property or a dynamic behavior or a state which is able to be measured or detected which relates to the cutting operation performed by the rotary cutting apparatus. The at least one working parameter may be a parameter related to the first and/or the second rotary device, the force means or any member of the rotary cutting apparatus participating to the cutting operation. Furthermore, the at least one working parameter may refer to any parameter which may be used to control the cutting operation.

Data representative of the at least one working parameter refers to data determined from the measured and/or detected working parameter. For example, a sensor measures a working parameter so as to output data representative of this working parameter. Furthermore, data representative of the working parameter also refers to data calculated according to the working parameter, for example calculating another parameter according to the working parameter or determining that a threshold value is reached. Examples, but not limiting, of what working parameters may be measured and/or detected are vibrations, dirtiness of the equipment and temperature.

Since the at least one working parameter is transmitted outside either the first or second rotary device or both while machining is performed, the monitoring unit allows a real-time control of the cutting operation. For example, it is possible to control the speed of rotation of the rotary devices and/or the feed speed of the work-piece.

This real-time control will provide for the possibility to directly reacting and solving deviation within the operation by e.g. varying the process, operation and/or machining conditions according to the measured working parameters, thereby improving the productivity of the rotary cutting apparatus. Furthermore, by measuring working parameters related to the first and/or second rotary device itself, it is possible to know in real-time the activity of said rotary device so as to know when maintenance is needed and, particularly, what kind of maintenance is needed. For example, when said rotary cutting device should be replaced, sharpened or ground. Hence, real-time transmission of working parameters will allow more efficient scheduling of the maintenance. Thus, by combining monitored working parameters and performance data, the monitoring unit will enable insights on maintenance and performance data for optimizing productivity of the rotary cutting apparatus.

According to one embodiment, the rotary cutting apparatus as defined hereinabove or hereinafter also comprises an interface transmission unit arranged onto the frame, wherein the monitoring unit is further configured for transmitting data through wireless transmission between the monitoring unit and the interface transmission unit.

According to one embodiment, the monitoring unit is being configured for measuring one working parameter. According to another embodiment, the monitoring unit is being configured for measuring more than one working parameter.

According to another embodiment, the monitoring unit as defined hereinabove or hereinafter is further configured for transmitting power energy through wireless transmission between the monitoring unit and the interface transmission unit. In the present disclosure, the term "power energy" refers to the energy needed to power the monitoring unit without the use of batteries. Thus, there will be no need to change batteries.

Suitably, the monitoring unit is configured for transmitting data together with power energy at a frequency between 1 and 25 kHz (between 1 and 25 thousand cycles per second) and it will enable wireless transmission of both data and power energy while avoiding unsatisfactory losses, which will happen when the wireless transmission is performed at high frequency, i.e. above 1 MHz (1 million cycles per second). When higher frequencies are used magnetic fields used for wireless transmission may be absorbed by the metals used in the equipment. If the magnetic fields are absorbed, they will heat the equipment which will cause problems. Therefore, the correct power energy frequency must be carefully selected.

According to yet another embodiment of the present rotary cutter device as defined hereinabove or hereinafter, each of the first and second pair of bearing housings comprises a stationary bearing housing coupled to the frame and a rotary bearing housing coupled to the first or the second shaft, wherein the monitoring unit comprises a rotary antenna coupled to a rotary bearing housing; and the interface transmission unit comprises a stationary antenna coupled to a stationary bearing housing of a same first or second pair of bearing housings, and wherein the interface transmission unit and the monitoring unit are configured for transmitting data and/or power energy between the stationary and the rotary antennas through wireless transmission.

Suitably, the monitoring unit comprises the at least one sensor for measuring at least one working parameter and outputting data representative of the at least one working parameter; a controller connected to the sensor for receiving data representative of the at least one working parameter, the controller being further configured for processing the data representative of the at least one working parameter and for transmitting the said data representative of the at least one working parameter to the interface transmission unit.

The monitoring unit may comprise at least one sensor selected from the group of a temperature sensor, a vibration sensor, a load sensor and a rotation sensor.

Suitably, the controller may comprise a memory for storing data which has been obtained from the sensor and/or data transmitted by the interface transmission unit and a calculator connected to the memory for calculating a new parameter. Since rotary tools can be assembled and disassembled in the rotary cutting apparatus several times, a memory which is able to store data obtained from the sensor or data transmitted by the interface transmission unit will allow the recovery and/also the surveillance of the operational history of the rotary cutting device at any time.

According to one embodiment, the at least one working parameter is selected from at least one of: a temperature at an external surface of the first and/or the second rotary devices, a temperature difference between the first and/or the second rotary devices, a vibration level of the first and/or the second rotary devices, a slippage between the first and the second rotary devices, the number of cuts performed by the first and/or the second rotary device(s) and the number of revolutions of the first and/or the second rotary device(s).

Suitably, the rotary cutting apparatus further comprises a display unit for displaying data transmitted by the monitoring unit.

Furthermore, the above-identified aspect of the present disclosure will also be achieved by a method for transmitting data comprising the following steps: providing a rotary cutting apparatus as defined hereinabove or hereinafter; measuring at least one working parameter with the monitoring unit; processing the data representative of the at least one working parameter; and transmitting the processed data representative of the at least one working parameter from the monitoring unit to an interface transmission unit through wireless transmission.

The method as defined hereinabove or hereinafter may further comprise the step of transmitting power energy from a power energy generator, positioned outside the first and/or the second rotary devices to the monitoring unit through wireless transmission.

Suitably, the steps of measuring at least one working parameter, processing the data representative of the at least one working parameter and transmitting data and/or power energy are performed while the first and/or the second rotary devices is rotated.

According to one embodiment of the method as defined hereinabove or hereinafter, one working parameter is measured. According to another embodiment of the method as defined hereinabove or hereinafter, more than one working parameter is measured.

Further features and advantages of the present disclosure will become apparent from the following detailed description of embodiments, given as non-limiting examples, with reference to the accompanying drawings listed hereunder.

DETAILED DESCRIPTION

Figure 1:
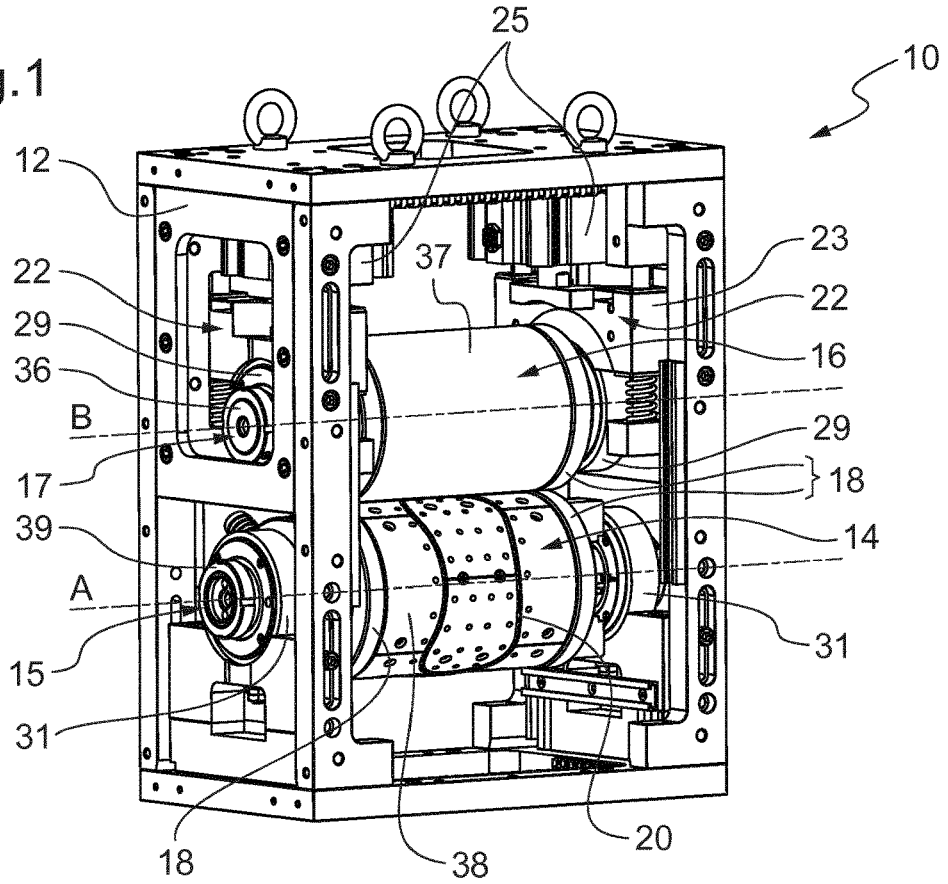
FIGS. 1 and 2 show schematically a perspective and a front views, respectively, of a rotary cutting apparatus with a rotary cutter and a rotary anvil in a cutting relationship.
Figure 2:
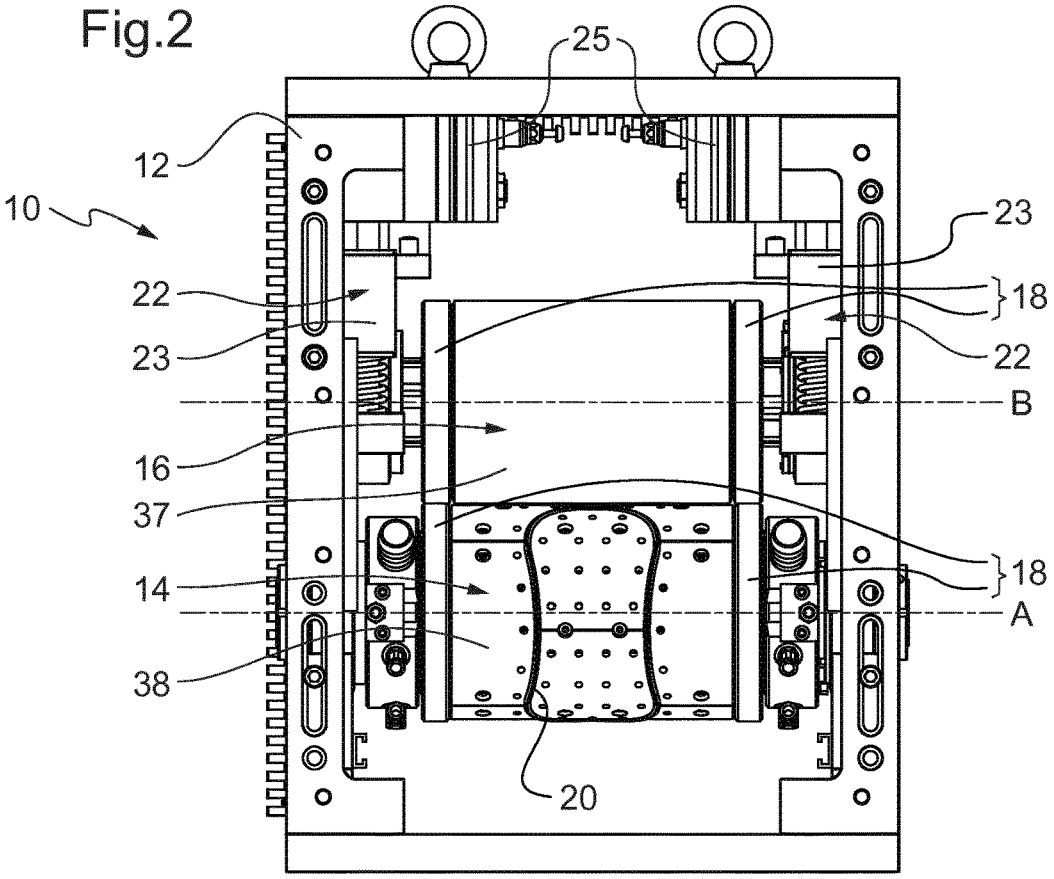

FIGS. 1 and 2 show a rotary cutting apparatus 10 comprising a frame 12 adapted to be attached to a not-shown basement. In the frame 12, a rotary cutter 14 and a rotary anvil 16 are arranged. The rotary cutter 14 and the rotary anvil 16 are shown in a cutting relationship. A cutting relationship refers to a specific position of the rotary cutter 14 and the rotary anvil 16 with respect to each other. Particularly, it refers to a position wherein a cutting edge 20 of the rotary cutter 14 is positioned close to the anvil's external surface, for example at a distance below 0.3 mm, or in contact with the anvil's external surface, depending on materials to be cut.

When a piece of web is passed through the rotary anvil 16 and the rotary cutter 14, the cutting edge 20 deforms the web until it is cut. The web may be selected from, for example but not limited to, non-woven material, woven material, plastic films, cellulose, cardboard, paper or metallic sheet. The products and trim obtained from the cutting operation may be separated directly by the effect of pressure, but may also be separated as they are moved in different directions or on different belts after the cutting operation. For instance, the product goes straight and trim goes upwards or downwards.

The rotary cutter 14 is provided with an elongated cutter shaft 15 and a cutter drum 38, the cutter drum 38 being coaxially arranged on the cutter shaft 15 about a rotation axis A. The shaft has an axial extension on each side of the cutter drum 38, where a pair of cutter bearing housings 31 is provided, respectively. The pair of cutter bearing housings 31 is each connected to the frame 12 by means of a fastening element, such as a screw. The cutter shaft 15 is preferably made of steel and is adapted to be connected to a not shown rotatable power source.

The cutter drum 38 is provided with a pair of annular support rings 18 and the cutting edge 20 for cutting articles from a web. The cutter drum 38 may be provided with more than one cutting edge 20, for example the cutter drum 38 may comprise a pair of annular cutter sleeves, each provided with cutting members or cutting edges. The support rings 18 may be separate parts. Alternatively, one of the support rings may be an integrated part of a cutter sleeve and the other support ring may be an integrated part of the other cutter sleeve. The cutting drum 38 may also comprise an intermediate annular sleeve without cutting edges between the annular cutter sleeves, the intermediate sleeve and the cutter sleeve being coaxially arranged in relation to the axis A. Alternatively, the cutter drum 38 may be made of one single piece, forming an integrated annular sleeve, the axial extension of which corresponding to that of the cutter drum 38.

The support rings 18, the annular cutter sleeves and/or the intermediate annular sleeve may be made of steel and/or a cemented carbide and/or a cermet. The rings may be press-fitted, shrink-fitted, screwed or glued onto a portion of the cutter shaft 15 having an enlarged diameter, altogether constituting said cutter drum 38.

The rotary anvil 16 is provided with an elongated anvil shaft 17 and an anvil drum 37, the anvil drum 37 being coaxially arranged on the anvil shaft 17 about a rotation axis B.

The anvil drum 37 comprises a pair of support rings 18 and an annular anvil sleeve coaxial to the axis B. The annular anvil sleeve and the support rings 18 may be made as a single piece, forming an integrated annular sleeve, the axial extension of which corresponding to that of the anvil drum 37 (see also FIG. 4). Alternatively, only one of the support rings may be an integrated part of the annular anvil sleeve. Alternatively, the support rings 18 may be separate parts. The annular anvil sleeve is preferably made of steel, but cemented carbide sleeves may also be used.

Figure 4:
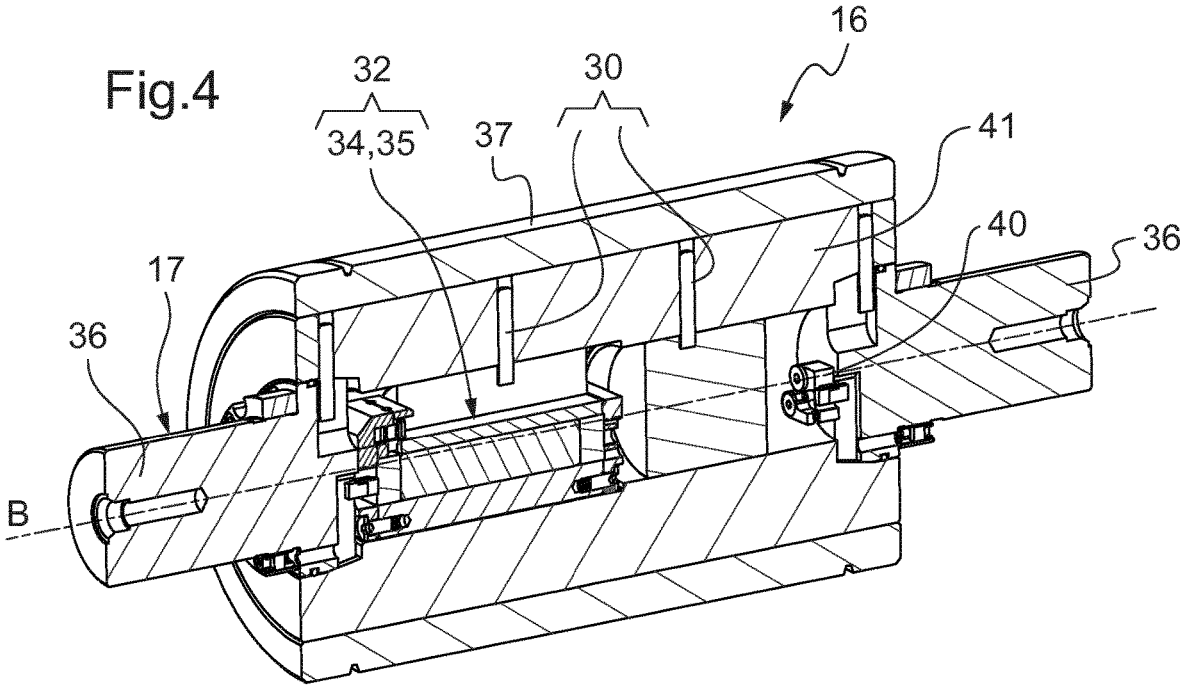
FIG. 4 shows schematically a cross-sectional view of the rotary anvil shown in FIGS. 1 and 2.

The support rings may be press-fitted or shrink-fitted or glued onto a portion of the anvil shaft 17 having an enlarged diameter, altogether constituting said anvil drum 37 (see also FIG. 4).

The support rings 18 of the anvil drum 37 are adapted to bear against the support rings 18 of the cutter drum 38 for positioning the rotary cutter 14 and the rotary anvil 16 in a cutting relationship during the cutting operation.

The anvil shaft 17 is arranged vertically above the cutter shaft 15 in such a way that the axis B is parallel to and is in the same plane as the axis A. Particularly, when the frame 12 is attached to a basement in a horizontal position, the axis B is parallel to and is in the same vertical plane as the axis A. Alternatively, the basement may be tilted relative to a horizontal or intermediate direction.

A pair of anvil bearing housings 29 is arranged on either sides of the anvil drum 37 and connected to a pair of craddles 23 of a force means 22.

A pair of cylinders 25 is used for pressing the craddles 23 including the pair of anvil bearing housings 29 and thus also the anvil support ring 18 as well as the external surface of the annular anvil sleeve towards and against the support rings 18 and the cutting edge 20 of the cutter drum 38, respectively. The cylinders 25 may be pneumaticly or hydraulicly moved. The cylinders may also be replaced by loading systems actuated by a screw-nut couple.

Figure 3:
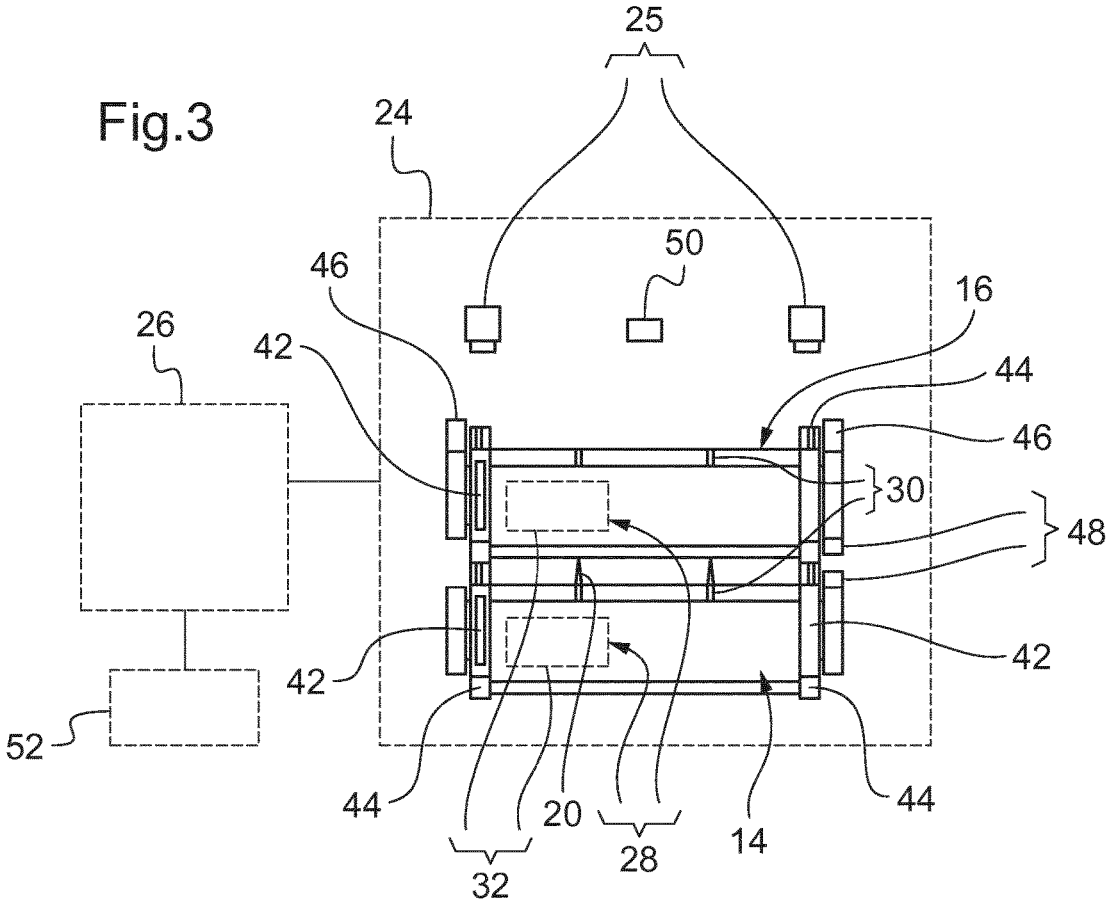
FIG. 3 shows a diagram representing data transmission between the monitoring unit of the rotary cutter or the rotary anvil, shown in FIGS. 1 and 2, and an interface transmission unit.

As shown in FIG. 3, the rotary cutting apparatus 10 comprises a cutting unit 24 comprising the rotary cutter 14 and the rotary anvil 16, an interface transmission unit 26 and a display unit 52. Each of the rotary cutter 14 and the rotary anvil 16 comprises a monitoring unit 28 for measuring a working parameter and for transmitting data representative of the working parameter between the monitoring unit 28 and an interface transmission unit positioned outside either the first or second rotary device or both. The monitoring unit 28 is at least partially embedded in at least one of the cutter drum 37 or anvil drum 38 of the rotary cutter 14 and the rotary anvil 16. In other words, at least one member of the monitoring unit 28, for example a sensor, is partially embedded in at least one of the cutter drum 37 or anvil drum 38. The other members of the monitoring unit 28 may be disposed outside the cutter drum 37 or anvil drum 38, for example in a housing on the side of the cutter drum 37 or anvil drum 38.

For the sake of clarity, even if both of the rotary cutter 14 and the rotary anvil 16 comprise a monitoring unit 28, only the monitoring unit 28 of the rotary anvil 16 is described below. The monitoring unit 28 of the rotary cutter 14 is structurally and functionally similar to the monitoring unit 28 of the rotary anvil 16 described below. Alternatively, the monitoring unit 28 of the rotary cutter 14 and the rotary anvil 16 may be different. For example, the monitoring unit 28 of the rotary cutter 14 and of the rotary anvil 16 may comprise different types of sensors or the monitoring unit 28 may be differently embedded in the cutter 37 and anvil 38 drums. Alternatively, the rotary cutting apparatus 10 may have only one of the rotary cutter 14 and of the rotary anvil 16 comprising a monitoring unit 28.

As shown in FIGS. 3 and 4, the monitoring unit 28 comprises temperature sensors 30 disposed within the rotary anvil 16 for measuring the temperature at the external surface of the rotary anvil 16 and for sending out a signal representative of this temperature to a controller 32 also placed/embedded within the rotary anvil 16. The controller 32 is configured for processing data representative of the working parameter received by the temperature sensors 30 and for transmitting said data representative of the working parameter to the interface transmission unit 26. The temperature sensors 30 will provide an indication as to the degree of thermal expansion of anvil's surface as an uneven thermal expansion will deform the tool and thereby disturb the cutting relationship.

Furthermore, the controller comprises a memory 34 and a calculator 35. The calculator 35 will enable the controller 32 to calculate a calculated parameter with respect to the working parameter measured by the sensors, such as the temperature difference within the rotary cutter 14 or the rotary anvil 16, or such as a temperature level by comparing a measured temperature to a predetermined temperature threshold.

The memory 34 will enables the storage of data representative of the working parameter outputted by the sensors and data coming from the interface transmission unit 26, such as a predetermined threshold. The data transmission from the sensors or from the interface transmission unit 26 to the memory 34 may be carried out continuously or at regular time intervals, even when a cutting operation is operated.

In order for the at least partially embedded measuring unit of the rotary anvil 16 to measure, process and store data representative of working parameter, the temperature sensors 30, the calculator 35 and the memory 34 may be embedded in the rotary anvil 16. As shown on FIG. 4, the anvil shaft 17 consists of two end shafts 36 assembled at each end of a central shaft 41 being coaxially arranged about the rotation axis B. The end shafts 36 are adapted to be disassembled from the central shaft 41 for enabling maintenance work of the temperature sensors 30, the calculator 35 and/or the memory 34. Alternatively, the calculator 35 and the memory 34 may be placed outside the anvil drum 37, for example integrated in a disk positioned on a side of the anvil drum 37.

Furthermore, for enabling recovery of the data representative of the working parameters processed by the controller 32 and/or stored in the memory 34, the monitoring unit 28 comprises a connector 40 reachable from outside the rotary anvil 16. The connector 40 is configured to be connected in an assembled position of the rotary anvil 16, i.e. a position in which the rotary anvil 16 may be operated for a cutting process. Therefore, data may be recovered while the rotary cutting apparatus is operated so that the interface transmission unit 26 is able to use data representative of the working parameters for controlling the cutting operation and/or to inform a user. Alternatively, data may also be recovered with the connector 40 in a disassembled position of the rotary anvil 16. The connector 40 may also be connected to an interface transmission unit, for example connected to a movable interface transmission unit or a computer, for recovering data representative of the working parameters in order to display or to document the history of the rotary anvil 16 independently from the rotary cutting apparatus 10.

For transmitting data representative of the working parameters on the exterior of the rotary anvil 16, when the rotary anvil 16 is assembled to the rotary cutting apparatus 10, the monitoring unit 28 is configured for transmitting these data through wireless transmission. In this embodiment, the monitoring unit 28 further comprises a rotary antenna 42 connected to the connector 40. The rotary antenna 42 is coupled to the rotary anvil 16 so that when the rotary anvil 16 is rotated, the rotary antenna 42 rotates in the same direction. For transmitting data representative of the working parameters to the interface transmission unit 26, a stationary antenna 44 is provided within the interface transmission unit 26. Both the stationary 44 and rotary 42 antennas consist in wound coils magnetically coupled together to form an induction system, thus ensuring that wireless data are transmitted. For improving the efficiency and quality of the wireless transmission between the stationary 44 and rotary 42 antennas, the stationary 44 and rotary 42 antennas are positioned close to each other, Particularly, the pair anvil bearing housings 29 comprises a rotary bearing housing coupled to the end shaft 36 and a stationary bearing housing coupled to the frame 12. The rotary antenna 42 is coiled and coupled to the rotary bearing housing and the stationary antenna 44 is coiled and coupled to the stationary bearing housing. In this way, when the rotary cutting apparatus is being operated, the rotary antenna 42 rotates together with the rotary anvil 16, whereas the stationary antenna is static with respect to the frame 12.

For ensuring a constant operability of the monitoring unit 28, the stationary 44 and rotary 42 antennas are further configured to transfer power energy though wireless transmission. In this way, the rotary anvil 16 does not need any battery. For transferring both data and power energy, data signal and energy waves are superimposed at a same frequency. For an efficient wireless transmission of both data and power energy, the data signal and the energy waves are transmitted at a frequency between 1 and 25 kHz (between 1 and 25 thousand cycles per second).

For transferring data and energy power from the interface transmission unit 26 to the controller 32, energy and data signals are superimposed and transmitted from the stationary antenna 44 to the rotary antenna 42. The energy and data signals are then separated by a demodulation electronic circuit disposed within the controller 32 to store the energy signal in power capacities and the data signal in the memory 34.

For transferring measured temperatures from the controller 32 to the interface transmission unit 26, load modulation principle is performed. Particularly, the current in the primary circuit of the induction system consisting of the stationary 44 and rotary 42 antennas is varied and then demodulated by an analogic electronic circuit. The data signal is then stored in a memory installed within the interface transmission unit 26.

The rotary anvil 16 may have one or more stationary 44 and rotary 42 antennas. Furthermore, the number of stationary 44 and rotary 42 antennas will depend on whether to dissociate or associate data and energy in same stationary 44 and rotary 42 antennas or to create a possible backup.

The monitoring unit 28 further comprises vibration sensors 46, rotation sensors 48 and load sensors 50.

The vibration sensors 46, such as accelerometers, are placed at different positions, for example on the rotary anvil 16, on the rotary cutter 14 or on the frame. Alternatively, the vibration sensors 46 may be also embedded in the rotary cutter 14 and the rotary anvil 16 and their data may be transmitted in the same way as described for the temperature data from the temperature sensors 30.

The rotation sensors 48 are associated with toothed wheels, one coupled to an end shaft 36 of the rotary anvil 16 and another one coupled to an end shaft 39 of the rotary cutter 14, to be able to determine the rotation speed of the rotary cutter 14 and the rotary anvil 16 and to detect the slippage between the rotary cutter 14 and the rotary anvil 16. The rotation sensors 48 may be of inductive, capacitive, Hall effect or encoder types. Alternatively, the rotation sensors 48 may be also embedded in the rotary cutter 14 and the rotary anvil 16 and their data may be transmitted in the same way as described for the temperature data from the temperature sensors 30.

The load sensor 50 is physically placed within the interface transmission unit 26 and measures the pressure applied on the rotary anvil 16 by the cylinders 22. The load sensors 50 may be load cells or pressure sensors in case of pneumatic or hydraulic loading systems. Alternatively, the load sensors 50 may also be embedded in the rotary cutter 14 and/or the rotary anvil 16 and their data may be transmitted in the same way as described for the temperature data from the temperature sensors 30.

Furthermore, the monitoring unit 28 is also configured to measure time through stationary and embedded clocks in order to track changes in a synchronized way.

The data representative of the working parameters are for example the temperature difference in the rotary cutter 14, the temperature difference, typically the difference between the maximum and minimum temperatures in the rotary anvil 16, the vibration level of the rotary cutter 14, the vibration level of the rotary anvil 16, the slippage between rotary anvil 16 and rotary cutter 14, the rotation speed of the rotary cutter 14, the rotation speed of the rotary anvil 16, the pressure in the cylinders 22, the number of cuts performed by the rotary cutter 14 and/or the number of cuts performed by the rotary anvil 16.

The rotary cutting apparatus 10 further comprises a display unit 52 for displaying the data representative of the measured working parameters or performance records. The display unit 52 comprises a Human Machine Interface (HMI), directly connected to the interface transmission unit 26 for displaying by means of a screen with a High-Definition Multimedia Interface (HDMI) or Video Graphics Array (VGA) port.

Figure 5:
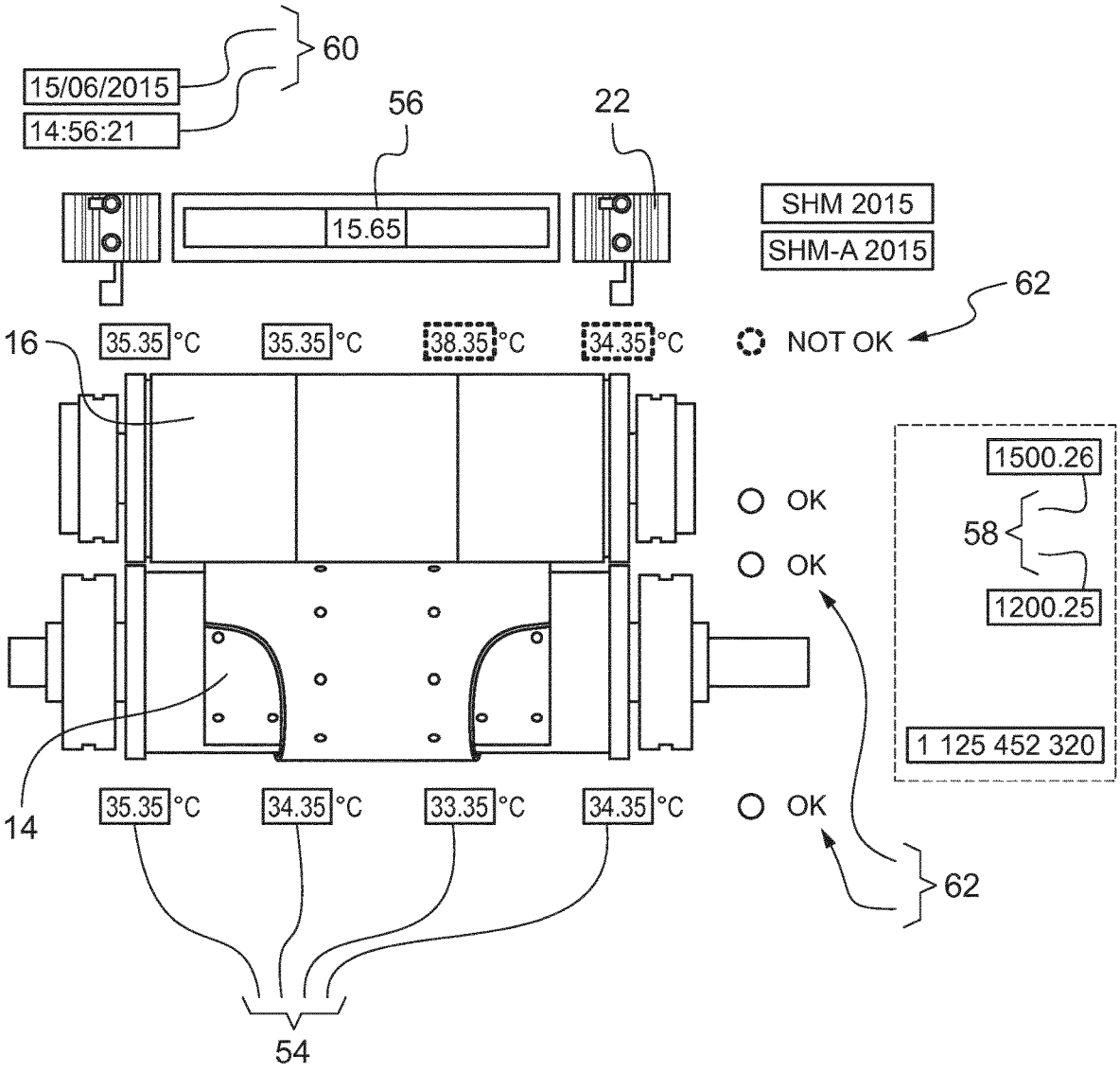
FIG. 5 shows schematically an example of an interface of a display unit displaying data representative of a working parameter of the rotary cutting apparatus shown in FIGS. 1 and 2.

An example of the interface displayed by the display unit 52 is shown in FIG. 5. The interface shows schematically the rotary cutter 14 and the rotary anvil 16 and the cylinders 22. Temperature values 54 are displayed at different positions corresponding to the positions of the temperature sensors 30. In a similar way, a pressure value 56, the rotation speed values 58 of the rotary cutter 14 and of the rotary anvil 16, a time value 60 and vibration, slippage and temperature over threshold indicators 62 are displayed.

The rotary cutting apparatus 10 may be operated for transmitting data and/or energy power using the following steps: a) measuring a working parameter with one of the sensors installed within the rotary cutting apparatus 10, b) determining data representative of the working parameter according to the measured working parameter, c) transmitting the processed data representative of the working parameter from the monitoring unit 28 to an interface transmission unit through wireless transmission, e.g. at frequency between 1 and 25 kHz. The rotary cutting apparatus 10 may also transmit power energy from a power energy generator fixed with respect to the frame 12 to the monitoring unit 28. The wireless transmission of data and power energy may be performed during the cutting operation.

For enabling maintenance of the rotary cutter 14 and/or the rotary anvil 16, such as re-grinding and re-sharpening, the rotary anvil 16 and the rotary cutter 14 may be provided with tight seals and protections so the maintenance may be carried out in the same way as for ordinary cutting apparatus.

Even though the present disclosure has been described with precise embodiments above, many variations are possible within the scope of the disclosure.

For instance, the monitoring unit 28 may comprise deformation gauges for measuring the deformation of the rotary cutter 14 and/or the rotary anvil 16, for example the deformation of the cutting edge 20.

Alternatively to the HMI, the interface may use standard or developed communications such as CANopen, Process Field Bus (Profibus) or a specific software.

Furthermore, the interface transmission unit 26 may also comprise alarms to signal abnormal data evolution and a possible need for maintenance and download ports, such as a Universal Serial Bus (USB) port, for directly downloading the data representative of the working parameters stored either in the memory 34 of the monitoring unit 28 and/or in a stationary memory of the interface transmission unit 26.

In one of the embodiment described above, both the rotary cutter 14 and the rotary anvil 16 comprise a monitoring unit 28 so as to transmit data and/or power energy from and to the interface transmission unit 26. Alternatively, the rotary cutting apparatus 10 may have only one of the rotary cutter 14 and the rotary anvil 16 comprising a monitoring unit 28.

The invention claimed is:

1. A rotary cutting apparatus comprising:

a frame;

a first rotary device comprising a first shaft concentrically arranged about a first rotational axis and a first drum concentrically arranged on said first shaft, said first shaft being provided with a first pair of bearing housings arranged on either sides of said first drum;

a second rotary device comprising a second shaft concentrically arranged about a second rotational axis and a second drum concentrically arranged on said second shaft, said second shaft being provided with a second pair of bearing housings arranged on either sides of said first drum;

said first and second rotary devices being arranged in said frame in such a way that said first and second rotational axes are substantially horizontal and substantially in the same plane; said second shaft being connected to the frame via said second pair of bearing housings;

said first shaft being associated with said frame via said first pair of bearing housings, said first pair of bearing housings being movable relative to the frame in a transverse direction to said first rotational axis such that the first and second drums come into a cutting relationship with one another; and a monitoring unit embedded in at least one of the first or the second drums of the first and the second rotary devices, the monitoring unit being configured for measuring at least one working parameter and for transmitting data representative of the at least one working parameter between the monitoring unit and an interface transmission unit positioned outside either the first or second rotary device or both, wherein the monitoring unit is further configured for transmitting data through wireless transmission between the monitoring unit and the interface transmission unit, wherein each of the first and second pair of bearing housings comprises a stationary bearing housing coupled to the frame and a rotary bearing housing coupled to the first or the second shaft, wherein, in one of the first and second pair of bearing housings, the monitoring unit comprises a rotary antenna coupled to the rotary bearing housing, and the interface transmission unit comprises a stationary antenna coupled to the stationary bearing housing, and wherein the interface transmission unit and the monitoring unit are configured for transmitting data and/or power energy between the stationary and the rotary antennas through wireless transmission.

2. The rotary cutting apparatus according to claim 1, wherein the interface transmission unit is arranged on the frame.

3. The rotary cutting apparatus according to claim 2, wherein the monitoring unit is further configured for transmitting power energy through wireless transmission between the monitoring unit and the interface transmission unit.

4. The rotary cutting apparatus according to claim 3, wherein the monitoring unit is configured for transmitting data together with power energy at a frequency between 1 and 25 kHz.

5. A method for transmitting data comprising in the following steps:

providing a rotary cutting apparatus according to claim 3;

measuring at least one working parameter with the monitoring unit;

determining data representative of the at least one working parameter according to the measured working parameter;

processing the data representative of the at least one working parameter; and transmitting the processed data representative of the at least one working parameter from the monitoring unit to an interface transmission unit through wireless transmission.

6. The method according to claim 5, further comprising the step of transmitting power energy from a power energy generator, positioned outside the at least one among the first and the second rotary devices including the monitoring unit, to the monitoring unit through wireless transmission.

7. The method according to claim 6, the step of measuring at least one working parameter, determining and processing the data representative of the at least one working parameter and transmitting data and/or power energy are performed while the at least one among the first and the second rotary devices including the monitoring unit is rotated.

8. The method according to claim 5, the step of measuring at least one working parameter, determining and processing the data representative of the at least one working parameter and transmitting data and/or power energy are performed while the at least one among the first and the second rotary devices including the monitoring unit is rotated.

9. The rotary cutting apparatus according to claim 1, wherein the monitoring unit comprises:

at least one sensor for measuring at least one working parameter and outputting data representative of the at least one working parameter;

a controller connected to the sensor for receiving data representative of the at least one working parameter, the controller being further configured for processing the data representative of the at least one working parameter and for transmitting said processed data representative of the at least one working parameter to the interface transmission unit.

10. The rotary cutting apparatus according to claim 9, wherein the monitoring unit comprises at least one sensor selected from at least one of a temperature sensor, a vibration sensor, a load sensor and a rotation sensor.

11. The rotary cutting apparatus according to claim 10, wherein the controller comprises:

a memory for storing data outputted by the sensor or data transmitted by the interface transmission unit; and a calculator connected to the memory for calculating a calculated parameter with respect to the data representative of the at least one working parameter outputted by the sensor.

12. The rotary cutting apparatus according to claim 11, wherein the data representative of the at least working parameter is selected from at least one of: a temperature at an external surface of the first and/or the second rotary devices, a temperature difference in the first and/or the second rotary devices, a vibration level of the first and/or the second rotary devices, a slippage between the first and the second rotary devices, a number of cuts done by the first and/or the second rotary devices and a number of revolutions of the first and/or the second rotary devices.

13. The rotary cutting apparatus according to claim 12, further comprising a display unit for displaying data transmitted by the monitoring unit.

14. The rotary cutting apparatus according to claim 1, wherein the first rotary device is a rotary cutter and the first drum is an anvil drum.

15. The rotary cutting apparatus according to claim 1, wherein the first rotary device is a rotary anvil and the first drum is a cutter drum.

16. A rotary cutting apparatus comprising:

a frame;

a first shaft concentrically arranged about a first rotational axis and a first drum concentrically arranged on said first shaft, said first shaft being provided with a first pair of bearing housings arranged on either sides of said first drum;

a second rotary device comprising a second shaft concentrically arranged about a second rotational axis and a second drum concentrically arranged on said second shaft, said second shaft being provided with a second pair of bearing housings arranged on either sides of said first drum;

said first and second rotary devices being arranged in said frame in such a way that said first and second rotational axes are substantially horizontal and substantially in the same plane; said second shaft being connected to the frame via said second pair of bearing housings;

said first shaft being associated with said frame via said first pair of bearing housing, said first pair of bearing housings being movable relative to the frame in a transverse direction to said first rotational axis such that the first and second drums come into a cutting relationship with one another; and a monitoring unit embedded in at least one of the first or the second drums of the first and the second rotary devices, the monitoring unit being configured for measuring at least one working parameter and for transmitting data representative of the at least one working parameter between the monitoring unit and an interface transmission unit positioned outside either the first or second rotary device or both, wherein the monitoring unit is further configured for transmitting power energy through wireless transmission between the monitoring unit and the interface transmission unit; and an interface transmission unit arranged on the frame, wherein the monitoring unit is further configured for transmitting data through wireless transmission between the monitoring unit and the interface transmission unit, wherein each of the first and second pair of bearing housings comprises a stationary bearing housing coupled to the frame and a rotary bearing housing coupled to the first or the second shaft, wherein, in one of the first and second pair of bearing housings, the monitoring unit comprises a rotary antenna coupled to the rotary bearing housing, and the interface transmission unit comprises a stationary antenna coupled to the stationary bearing housing, and wherein the interface transmission unit and the monitoring unit are configured for transmitting data and/or power energy between the stationary and the rotary antennas through wireless transmission.

17. The rotary cutting apparatus according to claim 16, wherein the monitoring unit is configured for transmitting data together with power energy at a frequency between 1 and 25 kHz.

18. The rotary cutting apparatus according to claim 16, wherein the monitoring unit comprises:

at least one sensor for measuring at least one working parameter and outputting data representative of the at least one working parameter; and a controller connected to the sensor for receiving data representative of the at least one working parameter, the controller being further configured for processing the data representative of the at least one working parameter and for transmitting said processed data representative of the at least one working parameter to the interface transmission unit.

19. The rotary cutting apparatus according to claim 18, wherein the monitoring unit comprises at least one sensor selected from at least one of a temperature sensor, a vibration sensor, a load sensor and a rotation sensor.

20. The rotary cutting apparatus according to claim 19, wherein the controller comprises:

a memory for storing data outputted by the sensor or data transmitted by the interface transmission unit; and a calculator connected to the memory for calculating a calculated parameter with respect to the data representative of the at least one working parameter outputted by the sensor.

* * * * *